US008365501B2

(12) United States Patent
Long, Sr.

(10) Patent No.: US 8,365,501 B2
(45) Date of Patent: Feb. 5, 2013

(54) WIDE-BODY CONNECTOR FOR CONCRETE SANDWICH WALLS

(75) Inventor: Robert T. Long, Sr., Ames, IA (US)

(73) Assignee: Composite Technologies Corporation, Boone, IA (US)

( * ) Notice: Subject to any disclaimer, the term of this patent is extended or adjusted under 35 U.S.C. 154(b) by 1278 days.

(21) Appl. No.: 10/033,216

(22) Filed: Dec. 26, 2001

(65) Prior Publication Data

US 2003/0115831 A1 Jun. 26, 2003

(51) Int. Cl.
*E04C 2/54* (2006.01)

(52) U.S. Cl. ..... 52/786.13; 52/309.7; 52/309.16

(58) Field of Classification Search ..... 52/309.7, 52/309.11, 410, 786.13, 309.16, 309.12; 403/292, 294, 298, 286, 408.1
See application file for complete search history.

(56) References Cited

U.S. PATENT DOCUMENTS

| | | | | |
|---|---|---|---|---|
| 1,958,049 | A | | 5/1934 | Kleitz |
| 2,412,744 | A | | 12/1946 | Nelson |
| 2,653,469 | A | | 9/1953 | Dallan |
| 4,052,831 | A | | 10/1977 | Roberts et al. |
| 4,283,896 | A | | 8/1981 | Fricker et al. |
| 4,329,821 | A | | 5/1982 | Long et al. |
| 4,348,847 | A | | 9/1982 | Jukes |
| 4,393,635 | A | | 7/1983 | Long |
| 4,545,163 | A | | 10/1985 | Asselin |
| 4,624,089 | A | | 11/1986 | Dunker |
| 4,632,796 | A | | 12/1986 | Moulet |
| 4,805,366 | A | | 2/1989 | Long |
| 4,829,733 | A | | 5/1989 | Long |
| 4,973,211 | A | * | 11/1990 | Potucek ..... 411/452 |
| 4,974,381 | A | | 12/1990 | Marks |
| 5,440,845 | A | | 8/1995 | Tadros et al. |
| 5,454,661 | A | * | 10/1995 | Litvin et al. ..... 403/298 |
| 5,519,973 | A | | 5/1996 | Keith et al. |
| 5,671,574 | A | | 9/1997 | Long |
| 5,673,525 | A | * | 10/1997 | Keith et al. ..... 52/309.11 |
| 5,996,297 | A | * | 12/1999 | Keith et al. ..... 52/410 |
| 6,018,918 | A | | 2/2000 | Long, Sr. |
| 6,116,836 | A | | 9/2000 | Long, Sr. |
| 6,138,981 | A | * | 10/2000 | Keith et al. ..... 249/41 |
| 6,263,638 | B1 | | 7/2001 | Long, Sr. |
| 6,511,252 | B1 | * | 1/2003 | Andros ..... 403/283 |

FOREIGN PATENT DOCUMENTS

| | | |
|---|---|---|
| DE | 1683498 | 9/1967 |

* cited by examiner

*Primary Examiner* — Basil Katcheves
(74) *Attorney, Agent, or Firm* — Brick Gentry P.C.; Brian J. Laurenzo

(57) ABSTRACT

Wide-body connectors are provided for concrete sandwich walls. Each connector includes a body with longitudinally thickened portions defining flanges and a thinner inner connecting web extending between the flanges. The flanges provide increased bending stiffness for the connector, while the web provides enhanced shear transfer between the concrete layers of the wall. Anchoring surfaces are formed into or overmolded onto the body to anchor the ends of the connector in the concrete layers of the wall and assist in the creation of end moments ofr the transfer of forces between the concrete layers. Preferably, a lip is provided on the connector to limit the penetration of the connector through the insulation layer of the wall. The connectors transfer forces between the concrete layers, without thermal bridging, such that the wall has a substantially composite character.

6 Claims, 3 Drawing Sheets

WIDE-BODY CONNECTOR FOR CONCRETE SANDWICH WALLS

BACKGROUND OF THE INVENTION

The invention relates generally to concrete sandwich walls and, more specifically to concrete sandwich walls wherein the two concrete layers are tied together by a plurality of insulating connectors that are of a shape that provides significant shear transfer between the two concrete layers when the panel is subjected to forces applied normal to the plane of the panel and at the same time reduces the number of connectors required to provide such stiffness. The concrete sandwich walls are both stiff and strong while providing high thermal efficiency.

Insulated concrete sandwich walls are well known in the art. Typically, a concrete sandwich wall panel is created by installing a layer of insulating material between two layers of concrete. In order to create a safe assembly capable of resisting handling and service imposed forces, the insulation layer must be penetrated by a connection system that ties the two layers of concrete together.

Concrete sandwich wall panels can be constructed at the building site or at a remote site and transported to the building site. The panels are constructed in a horizontal orientation and then picked or tilted to a vertical orientation for placement as a component of a building wall structure. A first layer of concrete is poured and leveled in the form. The layer of insulation is then placed on top of the plastic concrete and a plurality of connectors are inserted through the insulation layer into the plastic concrete layer underneath. The second layer of concrete is then poured on top of the insulation layer. Accordingly, one end portion of the connectors is consolidated in the first concrete layer and the opposite end portion is consolidated in the second concrete layer. Upon setting of the concrete layers, the connectors tie the two concrete layers together with the insulation layer sandwiched therebetween.

Concrete sandwich wall panels clad the exterior of a building and must resist lateral forces (wind and seismic forces), gravity loads, and temperature-induced forces. Lateral forces as well as temperature differentials between the two concrete layers induce shear forces in the connection systems as well as bending, shear, and axial forces in both layers of concrete in the panel.

In the current art, sandwich panels are designed as composite, partially composite, or non-composite. A composite sandwich panel of a given total thickness will have nearly the same stiffness and strength as a solid panel of the same thickness, while a non-composite panel will have roughly the same stiffness and strength as the sum of the stiffness and strength values for the individual concrete layers comprising the wall panel. Partially composite walls will have stiffness and strength that are intermediate to the values for composite and non-composite panels.

Composite walls are normally constructed with steel trusses passing through the insulation. The steel trusses provide high shear stiffness and effectively limit differential slip between the concrete layers. These panels are therefore very efficient in resisting lateral loads. Unfortunately, these panels also have severely reduced insulation performance as the steel trusses have high thermal conductivity and bridge the insulation.

Non-composite and partially composite wall panels are normally constructed using flexible connectors that are installed perpendicular to the plane of the insulation. Because the connectors provide low shear restraint, large differential slip between the concrete layers is possible. In the current art, partially composite panels are constructed by removing sections of insulation to provide discrete through-thickness concrete zones. These zones are normally located at the ends and at intermediate points along the length of the panel and limit the local slip between the concrete layers; however, the flexible connectors between through-thickness concrete zones will allow local slip. Although the uncracked stiffness of such panels will be nearly the same as for a composite panel, partially composite panels will tend to crack at lower loads than composite panels.

Although composite and partially composite walls are much more efficient than non-composite walls in resisting normal horizontal forces, the connection system's enforcement of strain compatibility between the concrete layers can create undesirable behaviors. The primary function of an insulated concrete sandwich panel is to provide a thermal barrier between the ambient environment and the conditioned air within the building. The thermal barrier must, therefore, lead to significant temperature differentials between the two concrete layers. Consequentially, as one concrete layer increases in temperature, it expands in the plane of the panel. The connection system and the other concrete layer eccentrically restrain this expansion, leading to "thermal bowing" of the assembly analogous to that observed with a bi-metallic strip. Similar behavior will occur in composite or partially composite panels with different levels of prestressing between the two layers. While this can be primarily an aesthetic problem, it can also lead to failure of the sealant at the joints between panels. This effect is most dramatic at the building corners, where the differential movement is magnified by the geometry of the joint. Also, in many applications, both composite and partially composite panels have excess capacity.

In contrast to a composite wall connection system, a non-composite wall connection system allows nearly unrestrained in-plane movement of the two concrete layers. Thermal bow is minimized, and joint sealants are less likely to fail.

Each of the wall types therefore have positive and negative features. Although non-composite wall panels are generally too flexible or have insufficient strength to safely resist wind loads, many composite and partially composite wall panels have excess capacity and suffer from thermal and differential prestress bowing. There is a need for an intermediate, partially composite connection system for concrete sandwich panels that provides adequate resistance to lateral loads while providing reduced thermal bowing and provides a thermally efficient wall panel.

Prior art connecting systems generally include connectors made of wire or polymers. Such connectors are usually narrow or slender, and therefore have a low bending stiffness, which results in small shear transfer between the concrete layers. Merely increasing the dimensions or amount of material used in the prior art connectors is not a satisfactory solution. While such strategies will increase the strength of the connectors, much of the excess material does not add to the strength of the connector and is therefore wasted. Furthermore, such enlarged connectors will tend to twist in the concrete layer and consequently not develop the tension and compression forces at the extreme ends of the connectors that are necessary to ensure a transfer of shear.

U.S. Pat. No. 5,440,845 describes a concrete sandwich wall panel including insulating connectors having opposite end portions embedded in a corresponding one of the concrete layers or wythes. The connectors are referred to as two-way shear connectors and are capable of transferring longitudinal shear loads from one wythe to the other in multiple or, in an alternative embodiment, in all directions. The concrete sandwich panel wall is constructed so that the connectors are supported at their opposite end portions on elongated strands that are embedded, one each, in the two wythes. A number of diverse configurations of the connectors are described, including a strand, plurality of plate shaped connectors, I-shaped beams, and hinged or stapled straps. In all configurations, however, the connectors are functionally associated with the elongated strands to provide for the transmission of stresses between the wythes to accomplish the purposes of the assemblies as specified in the patent.

In contrast, the connectors of the present invention have no functional association with any elongated strands that may or may not be present in the concrete layers. While prestressing strands may be used in some applications of concrete sandwich walls of the present invention, when present, no connection or association is made between the prestressing strands and the insulating connectors. Rather, the connectors of the present invention are designed to provide the requisite transmission of forces merely by being consolidated in the concrete layers. The connectors of the present invention, therefore, provide more flexibility to the engineer or architect in designing the concrete sandwich wall, are much quicker and easier to construct, and do not require as much skill to construct.

Therefore, a primary objective of the present invention is the provision of an improved concrete sandwich wall panel that is stiff, strong and thermally efficient.

Another objective of the present invention is the provision of an improved connector for use in a concrete sandwich wall that develops end moments to ensure the transfer of shear between the concrete layers in which the connectors are embedded.

A further objective of the present invention is the provision of an improved connection system for concrete sandwich walls which allows for partial composite action.

Another objective of the present invention is the provision of a connector for concrete sandwich walls having sufficient bending stiffness to provide significant shear transfer between the two concrete layers when the panel is subjected to wind or seismic forces applied normal to the plane of the panel.

Another objective of the present invention is the provision of a wide-body connector for use in concrete sandwich wall panels that can be used either as curtain wall units or for carrying roof loads.

A further objective of the present invention is the provision of connectors for concrete sandwich walls, wherein each connector has a pair of spaced apart, longitudinally extending flanges interconnected by a web to provide enhanced performance for the wall panel.

Still another objective of the present invention is the provision of a connection system for concrete sandwich walls which reduces the thickness of the concrete layers and minimizes the number of connectors.

A further object of the present invention is the provision of a connection system for concrete sandwich walls that require less skill and are faster and less expensive to construct.

These and other objectives will become apparent from the following description of the invention.

BRIEF SUMMARY OF THE INVENTION

The connectors of the present invention are formed of a thermally insulative material, such as fiber-reinforced polymer, and are intended for use in a concrete sandwich wall having spaced apart layers of concrete with an insulation layer sandwiched therebetween. Each connector includes an elongated body that extends through the insulation layer and opposite ends that extend into the respective concrete layers. Anchoring surfaces are provided in the opposite ends to facilitate anchorage of the connector in the concrete and to develop end moments to assist in the transfer of shear between the layers of concrete. The connectors are not attached to or functionally associated with an reinforcing members or elongated strands that may be present in the concrete layers.

The body of each connector has a width that is typically twice the thickness of the body. The body includes longitudinally extending thickened portions that define longitudinally extending flanges that are interconnected by a thinner central web. The flanges and web provide bending stiffness for the connector and enhance shear transfer between the concrete layers. Each connector preferably includes a lip extending partially or fully around the body so as to limit penetration of the connector through the insulation layer.

DETAILED DESCRIPTION OF THE INVENTION

Figure 3:
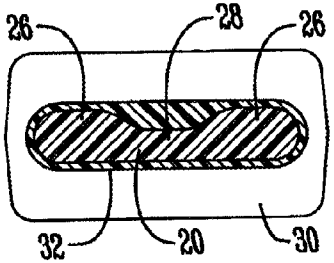
FIG. 3 is a sectional view taken along lines 3-3 of FIG. 1.
Figure 2:
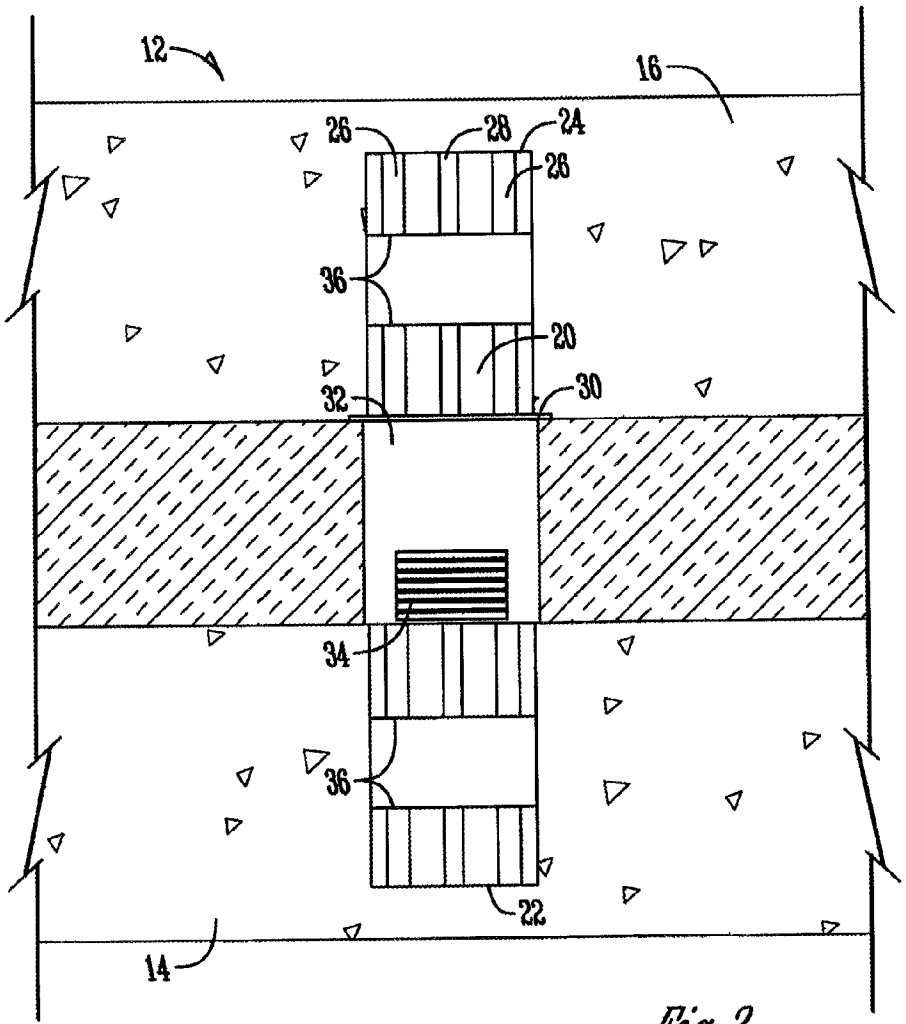
FIG. 2 is a partial sectional view through a concrete sandwich wall panel showing one of the connectors in place.
Figure 1:
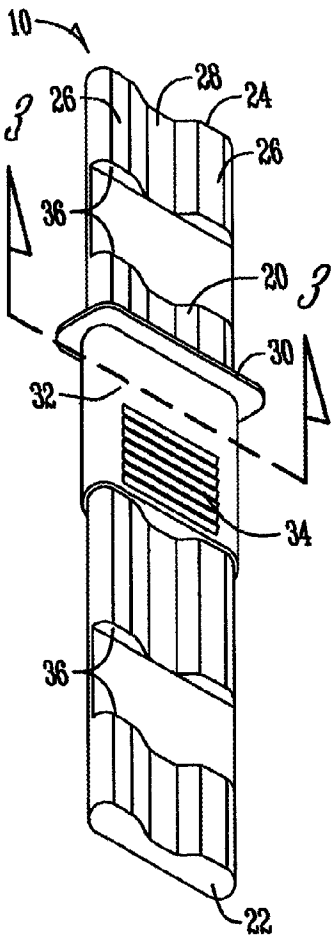
FIG. 1 is a perspective view of a first embodiment of the wide-body connector of the present invention.

A first embodiment of the wide-body connector of the present invention is generally designated by the reference numeral 10 in FIGS. 1-3. The connector 10 is intended for use in a concrete sandwich wall 12 having a first concrete layer 14, a second concrete layer 16 and an insulation layer 18 sandwiched therebetween.

The connectors 10 are made of high R-value material, so as to eliminate or minimize thermal transfer between the concrete layers.

The connector 10 includes an elongated body 20 having opposite ends 22, 24. As seen in FIGS. 1 and 3, the width of the body 20 is preferably at least 4-6 times the thickness of the body 20. The body 20 includes spaced apart thickened portions that run the length of the body 20. These thickened, longitudinally extended portions generally define flanges 26 that enhance the bending stiffness of the connector 10. The two flanges 26 are spaced laterally apart and are interconnected by a thinner central portion or web 28.

A lip 30 is provided on the body 20 and functions to limit the penetration of the body 20 through the insulation layer 18 by engaging the surface of the insulation layer, as seen in FIG. 2. In a preferred construction process, the lip 30 is overmolded onto the body 20. The lip may be part of an encasement 32 including ribs 34 that facilitate retention of the connector 10 in the insulation layer 18.

The body 20 also includes anchoring surfaces 36 adjacent each end 22, 24, which enhance retention of the connector 10 in the concrete layers 14, 16. The anchoring surfaces 36 are formed into the body 20 in any convenient manner. In a preferred manufacturing process, the body 20 is formed by pultrusion, and the anchoring surfaces 36 are cut or milled into the body 20 after the polymer material has hardened. Materials preferred for use in forming the connectors 10 and body 20 are fiber reinforced polymers, including glassreinforced thermoset resins, such as DERAKANER® epoxy vinyl resin (Dow Chemical).

The connectors 10 are installed in the wall panel 12 in a conventional manner, with corresponding slots or holes precut or formed in the insulation layer 18 at the appropriate locations. Generally, the first concrete layer 14 is poured and the insulation layer 18 with preformed holes therein is set on top of the concrete layer 14. The connectors 10 are then pushed through the preformed holes in the insulation layer 18 until the lip 30 engages the insulation layer 18. Alternatively, the insulation layer 18 may in the form of strips that are placed at the preferred spacing corresponding to the positioning of the connectors 10 which are then pushed through the strips of insulation at the predetermined spacing. Thus, the first end 22 of the connector 10 is embedded in the first concrete layer 14, and the second end 24 of the connector 10 extends above the insulation layer 18. The second concrete layer 16 is then poured on top of the insulation layer 18 so as to embed the second end 24 of the connector 10 in the second concrete layer 16. The plasticity of the concrete layers allows the concrete to consolidate with the anchoring surfaces 36, such that the connector 10 ties the first and second concrete layers 14, 16 together. The concrete may be vibrated to hasten consolidation.

In use, the increased bending stiffness provided by the longitudinally extending flanges 26 allows the web 28 to provide enhanced shear transfer between the concrete layers 14, 16. Additionally, the anchoring surfaces 36 prevent or limit twisting of the end portions of the connectors 10 in the concrete layers 14, 16, thus permitting the development of end moments, either positive or negative, on the ends of the connectors 10. The connectors 10, accordingly, are effective at transferring shear between the concrete layers 14, 16 and so add to the composite characteristics of the concrete wall panel 12. Additionally, the connectors 10 allow for reduced-thickness concrete layers 14, 16 and/or a reduced number of connectors in the wall panel 12.

Figure 4:
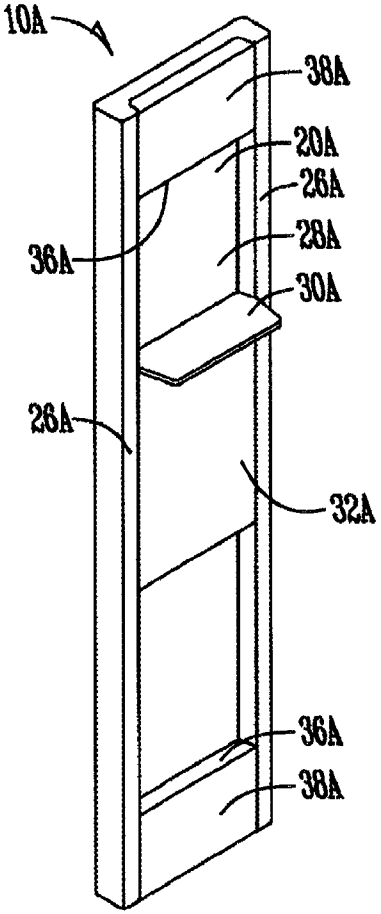

FIGS. 4-8 show alternative embodiments of the connector with similar parts labeled with the same reference numerals, and the suffix is A-E. Thus, FIG. 4 shows a perspective view of a connector 10A with flanges 26A and an interconnecting web 28A. The lip 30A extends from one side of the connector 10A, rather than 360° around the connector, as seen in the connector of FIGS. 1-3. The anchoring surfaces 36A of the connector 10A are formed by a portion 38A overmolded on the ends of the body 20A.

Figure 5:
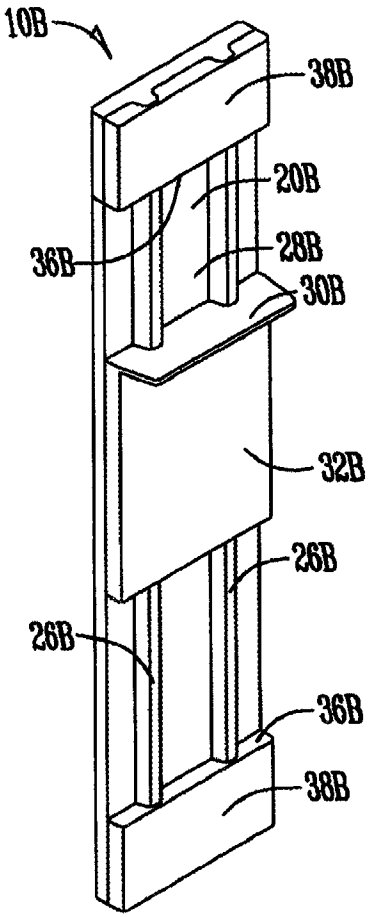

FIG. 5 shows a connector 10B with flanges 26B and an interconnecting web 28B. The flanges 26B are spaced inwardly from the opposite sides of the body 20B. The lip 30B extends from one side of the connector 10B, and the anchoring surfaces 36B are formed with an overmolded portion 38B.

Figure 6:
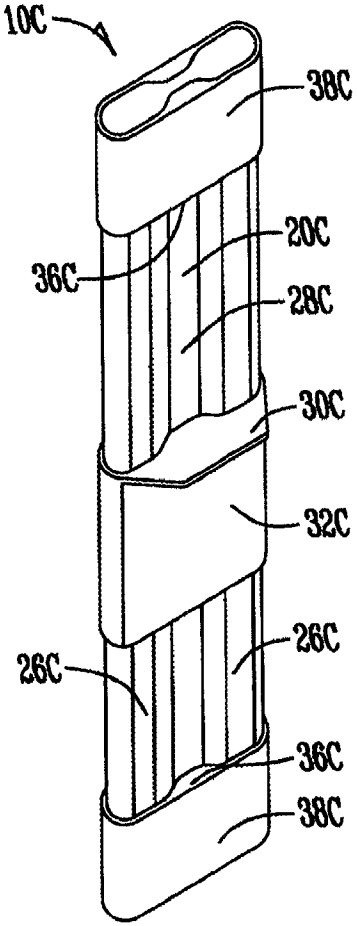
FIGS. 4-8 are perspective views showing alternative embodiments of wide-body connectors of the present invention.

FIG. 6 shows a connector 10C wherein the thickened portions defining the flanges 26C extend in opposite directions from the major cross-sectional axis of the connector 10C. The flanges 26C are interconnected by the thinner central web 28C. An overmolded portion 32C includes the lip 30C. Overmolded portions 38C define the anchoring surfaces 36C.

Figure 7:
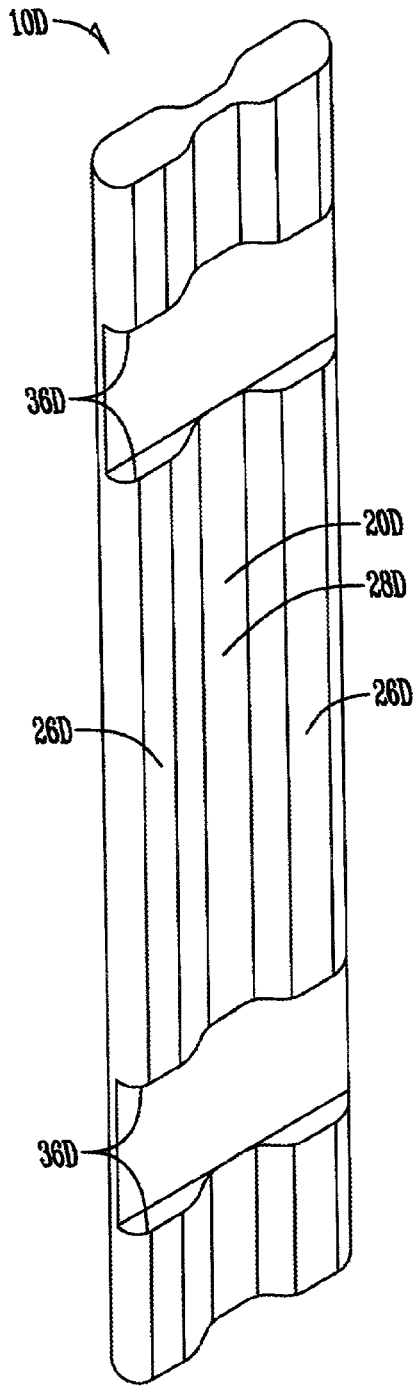

FIG. 7 shows yet another embodiment of a connector 10D having a body 20D that is substantially similar to the body 20C of the connector 10C shown in FIG. 6. The connector 10D does not include any overmolded portions, as with the connector 10C. The flanges 26D are interconnected by the web 28D, with anchoring surfaces 26D cut, milled or otherwise formed in the body 20D.

Figure 8:
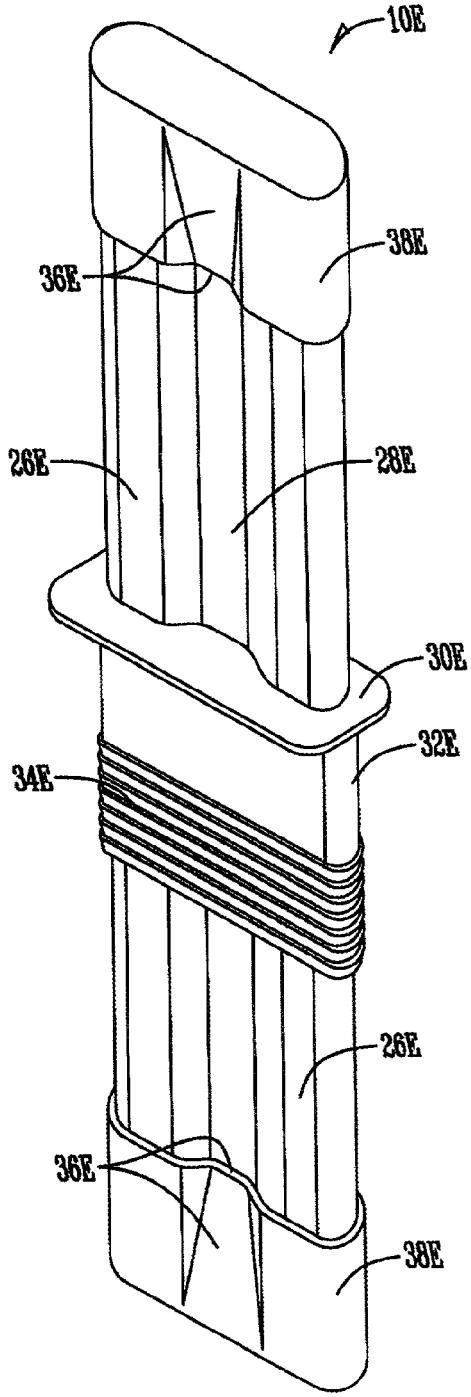

FIG. 8 shows another embodiment of a connector 10E. The connector 10E includes flanges 26E defined by C-shaped side portions. A thin interconnecting web 28E interconnects the flanges 26E. An encasement 32E, having a lip or flange 30E and ribs 34E, is overmolded onto the connector 10E, similar to the embodiment of FIG. 1. Overmolded portions 38E at the upper and lower ends of the connector provide an anchoring surface 36E for the connector. The ends 38E are rounded to facilitate insertion of the connector into the uncured concrete. In the preferred manufacturing process for connector embodiments A, B, C, and E, the body 20 is again formed by pultrusion, but the anchoring surfaces 36 are overmolded onto the body 20 after the polymer material in the pultruded part has partially or completely solidified. Materials preferred for use in forming the connectors 10 and body 20 include fiber-reinforced thermoplastic resins, such as ISOPLAST® resin (Dow Chemical). In the preferred manufacturing process for connector 10D, the body 20D is again formed by pultrusion. Connector 10D can be conveniently formed using thermoset resins with milled anchorage surfaces 36D, or using thermoplastic resins with thermally-mechanically formed surfaces 36D. Finally, still another manufacturing process that may be used for any of the connector embodiments shown is to injection mold the connectors using a fiber-reinforced thermoplastic resin. Using this process, all surface features of the connector are formed in a single process.

With the wide-body connectors of the present invention, a concrete sandwich wall has a substantially composite nature, since the connectors enhance the transfer of forces between the concrete layers, while also eliminating or minimizing thermal transfer or bridging between the concrete layers.

The preferred embodiment of the present invention has been set forth in the drawings, specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A wall panel comprising:

(a) spaced apart first and second concrete layers;

(b) an insulation layer between the concrete layer;

(c) a plurality of elongated connectors having a body extending through the insulation layer and having opposite ends embedded in the concrete layers, such that each end is surrounded by concrete, wherein the body has elongated portions longitudinally extending for the length of the body, wherein the longitudinally extending portions are laterally spaced apart and connected by an internal web of thinner or equal thickness running the length of the body; and (d) each connector having first and second anchorage surfaces adjacent to each end of the connector capable of transferring tension and compression forces along and parallel to the longitudinally extending portions.

2. The wall panel of claim 1 wherein the connectors transfer forces between the first and second concrete layers whereby the wall has a substantially composite character.

3. The wall panel of claim 1 wherein the connectors further comprise a centrally located region comprising a premolded, perpendicularly extending lip for locating the connector within the insulation layer, thereby regulating depth of embedment within the concrete layer.

4. The wall panel of claim 1 wherein the connectors are made from a polymer material including fiber reinforcements having thermal conductivity significantly lower than steel.

5. A connector for an insulated concrete wall comprising an elongated wide-body having longitudinally extending portions running the length of the connector between opposite ends, spaced apart, and connected by an internal web of thinner or equal thickness, running the length of the connector between opposite ends, and anchoring surfaces adjacent each end, configured such that tension and compression forces are transferred simultaneously through the first and second longitudinally extending portions.

6. A wall panel comprising:

(a) spaced apart first and second concrete layers;

(b) an insulation layer between the concrete layers;

(c) a plurality of elongated connectors extending through the insulation layer and having opposite ends entirely embedded in the concrete layers, wherein each connector has parallel longitudinally extending portions between opposite ends of the connector, laterally spaced apart and connected by an internal web of thinner or equal thickness extending between opposite ends of the connector; and (d) each connector having first and second anchorage surfaces capable of transferring tension and compression forces along and parallel to the longitudinally extending portions.

* * * * *